United States Patent [19]

Ball

[11] 4,015,432

[45] Apr. 5, 1977

[54] STABILIZING SUBSOIL MOISTURE UNDER LIGHT STRUCTURES

[76] Inventor: Henry F. Ball, 116 Reaves Court, Euless, Tex. 76039

[22] Filed: Dec. 26, 1974

[21] Appl. No.: 536,548

[52] U.S. Cl. ..... 61/35; 52/169.5; 61/10; 61/50

[51] Int. Cl.[2] ..... E02D 3/00

[58] Field of Search ..... 52/169, 742; 61/10, 61/11, 35, 50

[56] References Cited

UNITED STATES PATENTS

| | | | |
|---|---|---|---|
| 718,441 | 1/1903 | Ewen | 52/169 |
| 747,425 | 12/1903 | Hodges | 52/169 |
| 870,433 | 11/1907 | Hodges | 61/10 |
| 1,728,736 | 9/1929 | Shergold | 52/169 X |
| 1,811,009 | 6/1931 | Hartmann | 52/169 |
| 2,219,710 | 10/1940 | Litz et al. | 61/50 |
| 3,184,893 | 5/1965 | Booth | 52/742 |
| 3,543,459 | 12/1970 | Mills | 52/169 |

OTHER PUBLICATIONS

D. P. Krynine, Soil Mechanics, McGraw–Hill Book Co., Inc., New York, 1947, 2nd Edition, pp. 72 and 73.

*Primary Examiner*—Paul R. Gilliam
*Assistant Examiner*—David H. Corbin
*Attorney, Agent, or Firm*—Richards, Harris & Medlock

[57] ABSTRACT

Disclosed is a foundation structure supported on a soil moistened to its plastic limit. A moisture-controlling barrier is formed adjacent to and around the periphery of the foundation structure. The moisture controlling barrier inhibits the movement of the moisture from under the foundation by providing a capillary barrier prohibiting moisture movement by capillary action therethrough. The barrier permits moisture movement by percolation therethrough to establish and maintain the soil under the foundation at the plastic limit.

17 Claims, 8 Drawing Figures

PRIOR ART

STABILIZING SUBSOIL MOISTURE UNDER LIGHT STRUCTURES

BACKGROUND OF THE INVENTION

The present invention relates to improvements in foundations and methods of constructing the same. More particularly, the present invention relates to improvements in foundation structures and methods of constructing the same which reduce foundation failures and structural stresses caused by seasonal volume changes in supporting soil near the perimeter of the building as a result of fluctuations in the subsurface moisture content of the soil.

Expansive soils and the widely varying seasonal fluctuations in subsurface moisture content is a source of foundation distress in a very large number of residences. This is an especially severe problem in the Southern, Southwestern and Mid-western regions of the United States. Serious failures of foundation results in large expenditures on the part of homeowners. On the basis of previous studies, it has been estimated that an excess of $30 million per year is expended in foundation repair work in one metropolitan area alone. Nationwide, it has been estimated that at least 2.3 billion per year is expended to repair similar damage to houses, buildings, roads, and pipelines.

Although volume changes in all soils present problems with foundations for light structures, these problems are especially severe in areas where soils of the high-shrink-swell type (a plasticity index above 30) are found. Typical soils of this type are Houston Black Clay, soils yielded by the Taylor Marl and Eagle-Ford shale. These clays typically have a high montmorillinite content which causes the soils to have the extreme expansive characteristics.

In areas where high-shrink-swell soils are found, it is believed that many instances of building foundation stress is a result of migration of moisture from beneath the perimeter of the beams of the foundation, with resulting shrinkage of the soils and a loss of soil support at the perimeter of the foundation. This shrinkage occurs after extended periods of dry weather, common to the summer months in the South, Southwest and Midwest regions of the United States where evaporation by dry, hot winds and transpiration of plants deplete the moisture in the soil surrounding the foundation. The loss of moisture from the soil surrounding the foundation causes moisture in the protected area under the foundation to move by capillary action into the depleted surrounding soil whence it, too, may be transported into the atmosphere. This reduction of moisture content of the soil under the edges of the foundation causes the soil to shrink and move away from the foundation, thus, removing support under the exterior beams of the foundation. This removal of support under the exterior beams of the foundation can cause the foundation, masonry and interior sheetrock to be ruptured, doors and windows to be cracked and serious distresses to be induced in the structure of the building.

When the normal fall and winter rains replenish the soil moisture, the cycle is reversed. Moisture then migrates back under the foundation perimeter, swelling the supporting clays and moving the perimeter beams in a vertically upward direction. The perimeter of the foundation will continue to move up and down with the seasonal cycle with the magnitude of movement varying with the extremes of the wet-dry weather cycles.

These cyclic variations in soil volume are especially detrimental in conventional light structure building techniques wherein the structure is supported from a light slab type foundation. These light slabs tend to fail and deform under these conditions. Typical examples of these structures are homes, small buildings, canals, roads, railroads, pipelines, and the like.

The time of year when the building is constructed can also be an important factor, for if the foundation is formed during a wet period, the next seasonal dry period will cause moisture to move from under the edges of the foundation, causing the soil to shrink away from the foundation, removing support from the perimeter thereof. Conversely, if the foundation is constructed during the dry period, the next seasonally moist period will cause water to move by capillary action under the periphery of the foundation, swelling of the soil thereunder, and tending to lift the edges of the foundation.

Not only is the problem of shrinking and swelling of soil around the perimeter of the foundation present in the construction of new foundations, it is also present in the foundations of existing structures.

To solve these problems, a variety of corrective techniques have been used and the results vary widely. One technique is to utilize a massive slab and beam structure which will not fail as the soil shrinks and expands. Although, in some instances, these techniques may be successfully utilized, they are undesirable in that they are inordinately expensive and increase the construction costs in these structures. In addition, this technique cannot be used on existing foundations.

A second technique is to attempt to repair the damage to the existing foundations by grouting the cracks formed in the foundation due to the shrinking and swelling of the soil. These attempts tend to increase the damage to the foundation when the cycle is reversed in that the foundation cannot return to its original position because of grout material in the crack.

Other techniques have included attempts to stabilize the expansive soil present under a foundation. Stabilization techniques utilize lime slurry material which is injected into the soil under high pressure. The effectiveness of the use of this lime material is variable and believed to be a result of a chemical reaction that takes place between lime and clay whereby some types of clay particles are significantly altered and reduced in plasticity and increased in mechanical strength. It was believed that this chemical reaction could be achieved throughout the soil by mixing lime with the soil under the foundation. However, it has been found that such mixing is very limited. The process is quite expensive and the results are not predictable.

Another technique was the use of a subsurface irrigation system positioned under the foundation to control the moisture content of the soil under the foundation. In this technique, permeable hoses or pipe similar to the type used in lawn irrigation systems are placed in the soil of the foundation. A low head pressure of water was then connected to the pipes causing water to slowly percolate into the soil supporting the foundation. The irrigation system can be placed adjacent to the edge of the foundation and moisture sensors imbedded around the house to control the operation of the system. It is readily evident that these types of systems are expensive. In addition, they rely on mechanical devices of uncertain life and dependability.

Another technique involved the use of a polyethylene sheet to form a vertically extending moisture barrier to prevent movement of moisture from under the foundation and the soil outside the foundation. The polyethylene sheet method was discovered to be expensive and difficult to install, and left no way to naturally add water to the soil under the foundation.

Therefore, according to one embodiment of this invention, an improved foundation and method of constructing the same is disclosed wherein a moisture controlling barrier is placed around the periphery of the foundation for inhibiting the removal of moisture from under the foundation and preventing horizontal capillary migration of moisture through the barrier while allowing percolation of moisture through the barrier and into the soil under the foundation.

According to another embodiment of the invention, an improved method for forming a foundation is disclosed wherein moisture is added to the soil over which the foundation is to be formed until the soil reaches its plastic limit and thereafter, the foundation is constructed over the soil. A vertically extending moisture controlling barrier is formed around the perimeter of the foundation.

The present invention will be readily appreciated by those of ordinary skill in the art as the same becomes better understood by reference to the following detailed description when considered in connection with the accompanying drawings in which:

DESCRIPTION OF THE PREFERRED EMBODIMENT

Figure 1:
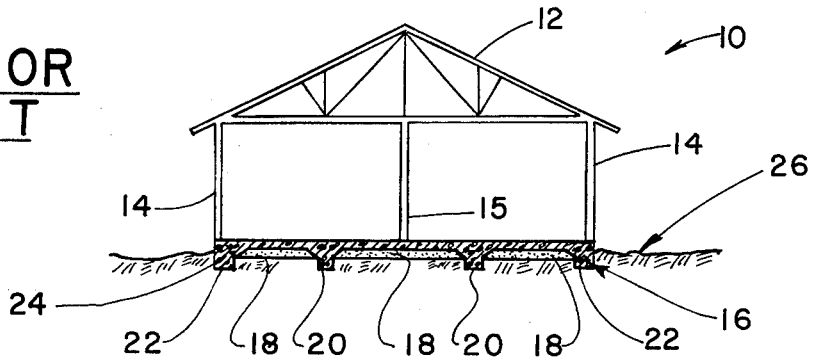
FIG. 1 PRIOR ART
FIG. 1 is a sectional view of a conventional light building, illustrating the foundation with the walls and roof supported therefrom.

Referring now to the drawings wherein like reference characters designate like or corresponding parts throughout the several views, there is illustrated in FIG. 1 a conventional building 10 having a roof 12, exterior side walls 14 and interior walls 15, which are supported on a conventional slab foundation 16. The building 10 has a typical light structure construction with the exterior walls 14 providing structural support. The slab 16 is also a conventional design for light structures and is formed on polyethylene material 17, and a sand cushion 18. The slab 16 has a plurality of interior and exterior beams 20 and 22, respectively. Structural steel members 24 can be cast in the slab 16. In this embodiment the building 10 is constructed in an area having a high-shrink-swell soil 26. In light structures, such as is shown in FIG. 1, a substantial support for the roof is provided by the exterior walls 15. Thus, any deflections in the slab at the periphery will induce stresses in the building 10 which can create damaging effects to the building.

A serious problem that has long eluded solution is the construction of light structures with slab type foundations on soils having high-shrink-swell ratios. The problem is especially acute in soils having a plasticity index in excess of 30, but it is also present, of course, in soil with a lower index.

Figure 2:
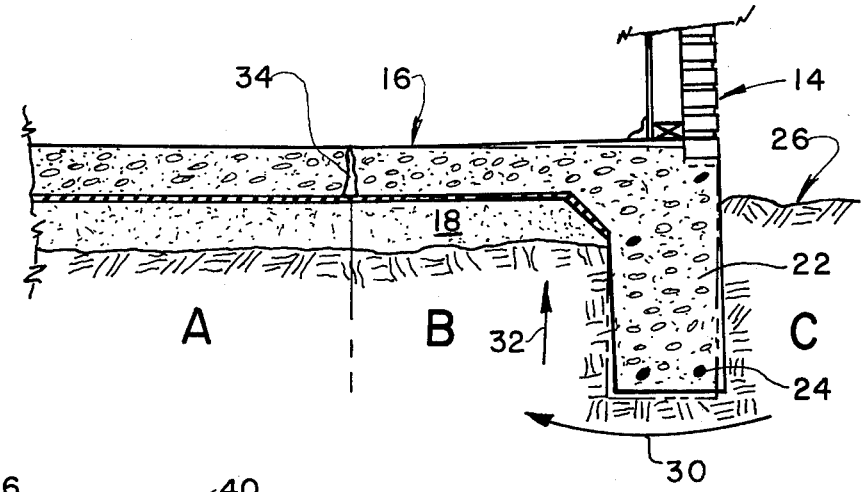
FIG. 2 is a partial section of a portion on the periphery of a conventional foundation, illustrating foundation cupping.

One of the possible damaging effects of constructing a light structure of the conventional slab design on high-shrink-swell soils is illustrated in FIG. 2. FIG. 2, specifically illustrates the damaging effects of these soils on the construction of a slab during a dry seasonal cycle followed by a wet seasonal cycle. This problem is classically called "slab cupping" and it is believed to be caused by volume changes of the soil 26 under the periphery of slab 16.

For purposes of description, the soil 26 will be divided into three areas. The soil in area A is located away from the periphery of the slab 16; the soil in area B is under the periphery of slab 16; while the soil in area C is around the outside of the slab 16. When the slab is constructed, the moisture content of areas A, B, and C is the same due to the equal exposure of the various areas to the environment. After the slab is constructed, only the soil in area C is exposed to the environment. If, as is illustrated in FIG. 2, the slab 16 is constructed during a dry period, and this period is followed by a wet seasonal cycle, moisture will enter the area C due to rainfall and other types of precipitation, causing a rise in moisture of Area C. As the soil around the perimeter of the slab in area C increases in moisture content, the moisture will migrate by capillary action down through the soil under the beam 22 and into the area B as illustrated by arrow 30. This is believed to be, because moisture will move through soil by capillary action from areas of high moisture content to areas of low moisture content. As this happens, the soil in area B increases in moisture content and due to the high-shrink-swell characteristics of the soil 26, the soil in area B will expand, thus forcing the periphery of the slab 16 upward in the direction of arrow 32. The upward lifting of the slab 16 overlying area B is because the soil in area B will have a higher moisture content and will expand more than the soil in area A. This lifting of the periphery of slab 16 can stress the slab 16 and cause cracks as shown at 34. In addition, the slab can move from the position shown in phantom lines to the position shown in solid lines. This causes an upward movement of the outer supporting wall 14 which can produce additional damage in the roof and walls of the building 10.

Figure 3:
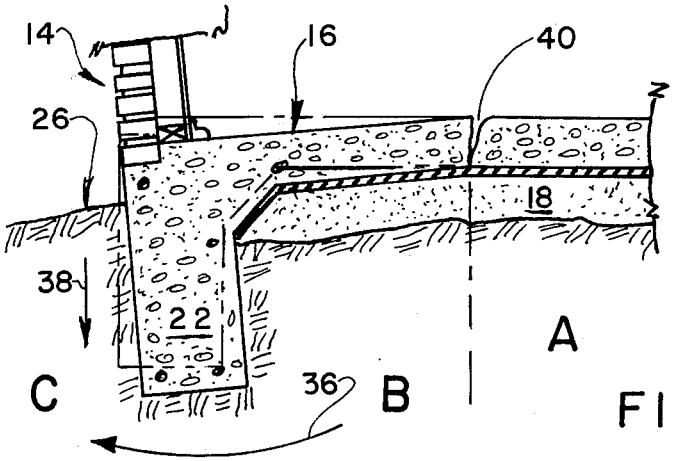
PRIOR ART FIG. 3
FIG. 3 is a view similar to FIG. 2, illustrating doming of the foundation.

In FIG. 3, a second example of a damaging effect present in constructing light structures on high-shrink-swell soils is disclosed. FIG. 3 specifically illustrates the damaging effects of these soils on the construction of slab 16 during a wet high moisture content seasonal cycle, followed by a dry seasonal cycle. This problem is classically called "slab doming." As was present in FIG. 2, the moisture content in areas A, B and C is the same before the slab 16 is constructed to equal exposure of these areas to the atmosphere. If slab 16 is constructed during a period when there is high pressure content in the soil 26, then the soil 26 will be in an expanded condition. If this construction period is followed by a dry seasonal cycle, moisture will be lost from the soil 26 in area C due to the evaporation and transpiration losses through plants. As the moisture content of area C is lowered, moisture from area B will move in the direction of arrow 36 down under beam 22 and into area C. This moisture migration is again the result of capillary action in the soil, causing moisture to move from an area of high moisture concentration to an area of low moisture concentration. If this process continues, the moisture content in area B will be less than the moisture content in the area A. This loss of moisture content in area B will cause a differential shrinkage of the soil in areas B and A. The soil in area B will shrink away from the slab 16 at the perimeter and will remove support and cause the beam 22 and the periphery of slab 16 to move from the position shown in phantom lines to the position shown in dotted lines. This movement is in the direction of arrow 38 and can cause cracks 40 to be formed in the slab 16. This downward movement of the exterior walls 14 can also produce structural failures within the roof and walls of the building 10.

It is also to be pointed out that when the seasonal cycles are reversed, the slab will return to its original position, thus causing a cyclic movement or stressing in the perimeter of the slab 16.

As was previously pointed out, various corrective techniques have been used, such as massive foundations, filling in the cracks in the foundations, lime-soil stabilization, subsurface irrigation, and polyethylene sheet material and the like. All these techniques have suffered one or more of the disadvantages of either being too expensive, too complicated to install, or inapplicability to existing foundations.

Figure 4:
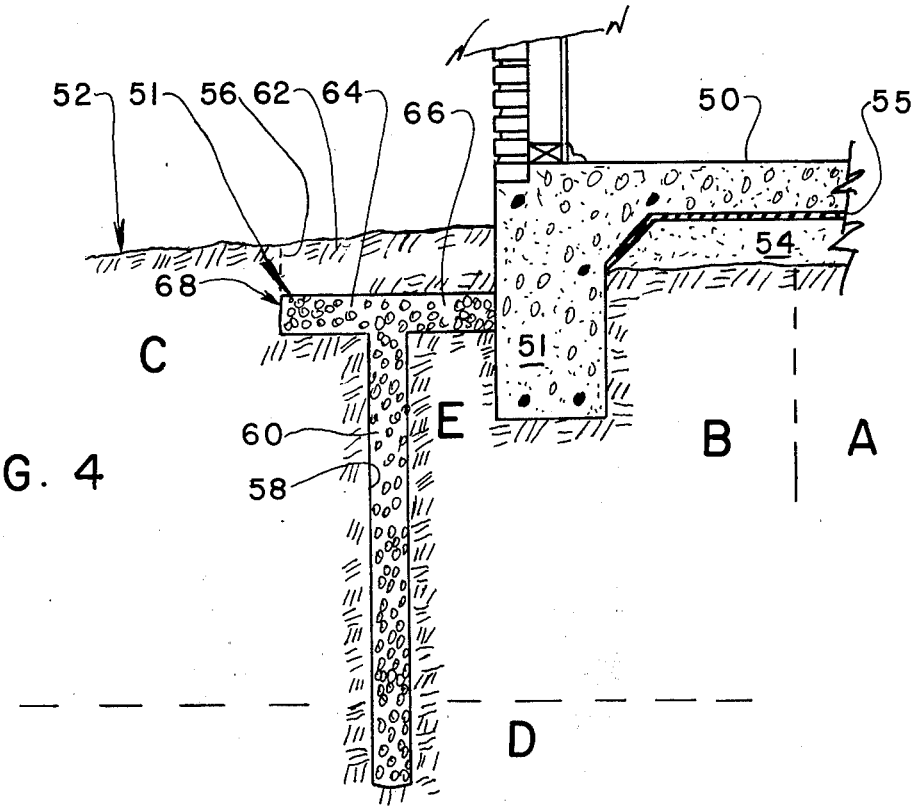
FIG. 4 illustrates a sectional view of a portion of the periphery of an improved foundation constructed in accordance with the teachings of the present invention.

According to a particular feature of the present invention, an improved foundation 48 with a moisture barrier 51 constructed in accordance with the first embodiment of the present invention is illustrated in FIG. 4. This foundation 48 and the method of installing the same have particular advantages when constructed in high-shrink-swell soils.

According to the present invention, the soil 52 is prepared prior to pouring the slab 50. The soil 52 is prepared by adding moisture, as necessary, to the soil which will eventually underlie the slab 50 until this soil is at least at its theoretical plastic limit.

For purposes of this application, the term "theoretical plastic limit" is defined as a moisture content which is identified in the Atterberg limits as the point at which the soil becomes plastic. It is believed that approximately 85% of the volume expansion of the soil has occured at this point. The addition of moisture to the soil 52 can be performed either before or after the site is prepared or the forms erected for pouring the foundation. After moisture is added to the soil 52 to bring the soil to at least the plastic limit, sand 54 can be placed in a conventional manner in the form. For purposes of the invention, it is preferable that the sand 54 be placed in the site after the soil has been brought to its plastic limit, in that the presence of the sand would inhibit testing of the moisture content of the soil below the sand.

After the sand 54 is in place, a sheet of polyethylene material 55 can be placed over the sand in a conventional manner.

Either before or after the slab 50 is formed, the moisture barrier 51 can be formed. The barrier 51 is formed by first excavating a wide shallow trench 56 completely around the periphery of the slab 50. A deeper trench 58 is also formed. In the preferred embodiment, this trench 58 can be 6 inches in width and extend to a depth of approximately 5 feet below the surface of soil 52. The trench 56 can be 2½ feet wide and a foot and a half in depth.

The slab 50 can be poured either before or after the trenches 56 and 58 are formed. This enables the trenches to be formed around completely constructed buildings.

The next step is to place an aggregate material 60 in the trenches 56 and 58. The aggregate material 60 fills the trench 58 and fills the bottom of the trench 56 to a depth of approximately 6 inches. The particles in material 60 are selected of a size which will prevent the movement by capillary action of moisture through material 60 and across the barrier 51. It has been found that aggregate with a minimum particle dimension greater than ¼ of an inch will provide a capillary barrier in a trench 6 inches wide. A typical aggregate would be "pea gravel" with 98% retained on a ¼-inch screen, with a maximum percent of wear of 35, such as is commonly used for highway surface treatment. It is believed that other particle sizes could be used which would also prevent capillary movement of the water and which would require wider or narrower trenching around the foundation.

The space above the aggregate 60 in trench 56 can then be filled with soil material 62. It should be pointed out that the depth of the soil material 62 can be changed as desired to allow for the planting of border plants, shrubs and the like. Thus, upon completion of the step of forming the moisture controlling barrier 51, a T-shaped aggregate section will extend completely around the slab 50. The trench 58 will form a vertical leg T with the section 64 of trench 56 extending from the trench 58 in a direction away from the slab 50 and the section 66 extending from the trench 58 in a direction to the exterior beam 51 of slab 50.

The advantages of this structure are many. First, as has been previously explained, the aggregate material 60 with a minimum particle dimension greater than ¼ of an inch will not support capillary action of water and therefore, movement of water by capillary action between the areas B and C is inhibited.

It is also believed that soil will not filter into the aggregate material because soils of the type which have the high-shrink-swell characteristics will tend to bridge and seal, preventing movement of soil into the trenches.

In addition, since the trench 58 extends 5 feet down, the depth identified as the limit of the active zone, the distance of travel for capillary action of water movement between areas B and C is sufficient to prevent substantial capillary moisture transfer between the areas.

The path of capillary moisture movement under trench 58 requires that the moisture move through a subsoil area D. Area D is of sufficient depth, so that its moisture content does not tend to vary as widely as it does the soil in area C. In fact, it can be fairly constant throughout the year. This inhibits capillary movement of water between areas B and C.

An additional advantage is found in the provision of the horizontally extending section 66. This section has an area of soil E located vertically thereunder, allowing moisture to move by percolation from the soil 60 through the section 66 and down into the area E. In this manner, the water-controlling barrier around a slab 50 operates to allow moisture to move into the soil under the slab 50, yet inhibits the movement of water from these areas under the slab. Horizontally existing section 64 provides an additional advantage. This section 64 tends to cause any vertical shrinkage cracks which may form in the soil to be located at 68 rather than adjacent to the slab 50. This is because cracks will tend to form at a plane where there is a differential in soil shrinkage and swelling.

It is apparent from the foregoing description of the embodiment of FIG. 4, that a moisture-controlling barrier 51 can be formed around a pre-existing distressed foundation with the trenches 58 and 56 excavated around the perimeter of the foundation. The distressed structure can be relieved and stabilized by introducing moisture as required into the supporting soil E, B through sections 60 and 66, which then will act as a barrier to any further loss of moisture by migration and evaporation.

Figure 5:
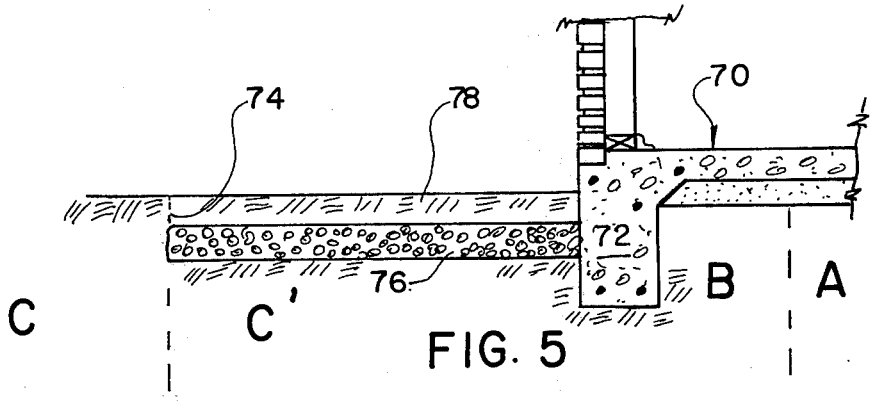
FIG. 5 is a second embodiment of an improved foundation constructed according to the present invention.

A second embodiment of the present invention is illustrated in FIG. 5. In this embodiment, the slab 70 has an exterior beam 72 formed in the manner described in FIG. 4 with the soil moistened up to the plastic limit.. In this embodiment, a wide, shallow trench 74 is formed around the periphery of the foundation. The trench 74 can be 1½ to 2 feet deep and 5 to 6 feet wide. A quantity of aggregates 76 forming a capillary barrier can be placed in the trench a depth, for example, of 6 inches. Thereafter, the soil 78 can be placed over the aggregate 76. In this embodiment, the variations in moisture content and shrinkage and swelling of the soil in the area B is substantially reduced because the substantial fluctuation in moisture content occurs in an area C′ under the aggregate material 76. This is due to the fact that the moisture movement by capillary action is substantially inhibited by the distance between the area B and the area C. In effect, this moves the areas of substantial fluctuations in moisture outside the slab 70, thus reducing the loads created by the cyclic variations in moisture content.

Figure 6:
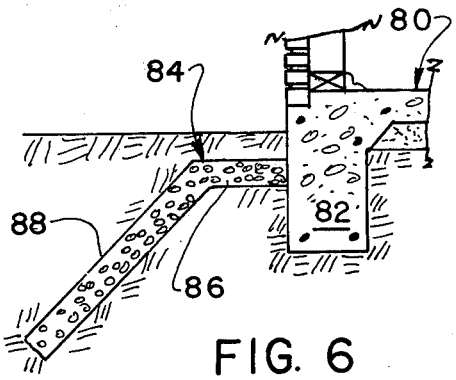
FIG. 6 is a third embodiment of an improved foundation constructed according to the present invention.

In FIG. 6, a third embodiment is illustrated wherein a conventional slab 80 with the external beam 82 is constructed as disclosed in FIG. 4. A moisture-controlling barrier 84 is formed of aggregate material and has a horizontal extending leg 86 and an outward and vertically downward extending leg 88. As disclosed with regard to the embodiments of FIGS. 4 and 5, this barrier 84 also acts as a water-controlling barrier inhibiting the capillary movement of water from under the slab 80 while allowing percolation of the water down through the leg 86 into the soil under the slab, thus tending to cause the soil under the slab to remain at the plastic limit.

Figure 7:
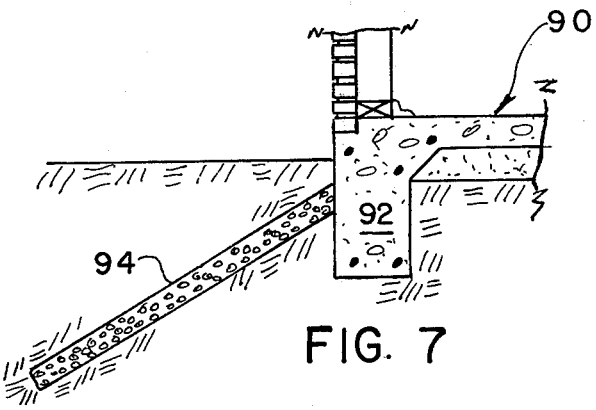
FIG. 7 is a fourth embodiment of the improved foundation constructed according to the present invention.

In FIG. 7, a fourth embodiment is illustrated wherein a conventional slab 90 with an exterior beam 92 is constructed in accordance with the slab in FIG. 4. A moisture-controlling barrier 94 is formed of aggregate material and extends down and away from the slab 90 as illustrated. As previously described, this barrier 94 inhibits the capillary movement of water from under the slab 90 while allowing percolation of water down into the area under the slab.

Figure 8:
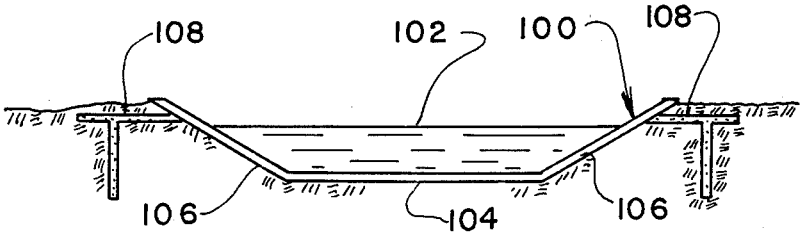
FIG. 8 illustrates a cross sectional view of a canal with one embodiment of the moisture control barrier of the present invention installed at the sides thereof.

In FIG. 8, a canal 100 for carrying a volume of water 102 is shown. It is to be pointed out that concrete structures of this type having a bottom 104 and upwardly extending side 106 can also have problems of differential soil expansion and contraction similar to buildings. To remedy this, a moisture control barrier 108 can be installed along the periphery of the sides 106 in any one of the embodiments disclosed herein. FIG. 8 therefore, illustrates the universal applicability of the present invention and it is to be understood, of course, that the water control barriers of the present invention could be used with structures other than canals and buildings such as pipelines, railroads, earth fills, etc., in areas of active soil after moisture stabilization.

Therefore, the present application discloses a moisture-controlling barrier positioned around a foundation which reduces foundation damage due to shrinking and swelling of the soil under the periphery of the foundation. The moisture-controlling barrier operates to inhibit the loss of moisture from under the foundation by capillary action, thus assisting in maintaining soil under the foundation in a stable condition at or in excess of the plastic limit. The moisture-controlling barrier also allows the movement of moisture into soil under the foundation to establish optimum moisture content and to ensure that the soil remains at or above the plastic limit.

The foregoing disclosure relates only to preferred embodiments of the present invention and it is to be understood, of course, that many modifications and alterations may be made therein by those of ordinary skill in the art without departing from the spirit and scope of the invention as set forth in the appended claims.

I claim:

1. In a method of constructing a light structure on a high shrink-swell soil having the steps of preparing the soil for pouring of a slab-type foundation; constructing a form for the foundation, placing sand within the form to provide a cushion for supporting the slab; placing structural steel within the form; pouring concrete material into the form and allowing the concrete material to harden to construct a slab; erecting a structure on the slab; and the improvement which comprises the steps of:

adding selective quantities of water to the soil until the moisture content is at least equal to the plastic limit in the area over which the slab is to be constructed; and constructing a moisture-controlling barrier of a predetermined width and depth in the soil and abutting the periphery of the slab whereby capillary movement of moisture from under the slab soil surrounding the slab is inhibited and whereby movement of water by percolation into the soil under the slab is permitted, the step of constructing the moisture-controlling barrier comprising forming a trench abutting the periphery of the slab; filling the trench with aggregate material having a minimum particle dimension in excess of ¼ of an inch.

2. The method of claim 1 wherein the step of forming a trench comprises forming a first leg of said trench extending vertically downward a sufficient distance to inhibit capillary movement of water thereacross thereby limiting loss of moisture from beneath the foundation and forming a second leg extending horizontally between the first leg and the slab for permitting percolation of water therethrough while inhibiting capillary movement of moisture across the second leg to maintain the moisture level in soil under the slab.

3. The method of claim 2 additionally comprising the step of forming a third leg extending horizontally from the first leg in a direction away from the slab.

4. The method of claim 1 wherein the step of forming the trench comprises forming a first leg extending horizontally from the periphery of the slab out away from the slab and forming a second leg extending from the first leg in a direction down and away from the slab.

5. The method of claim 1 wherein the step of forming the trench comprises forming a trench having a leg extending from the foundation in a direction down and away from the slab.

6. The method of claim 1 wherein said step of forming the trench comprises forming a leg extending horizontally out away from the foundation.

7. A structure for reducing damage to a slab due to shrinking and swelling of soil by stabilizing the moisture content of the soil at the periphery of the slab, comprising a moisture controlling barrier at the periphery of the slab; and the improvement which comprises said moisture controlling barrier comprising a trench of a predetermined width and depth abutting the periphery of the slab for inhibiting capillary movement of moisture from under the slab to the soil surrounding the slab and for permitting percolation of a moisture down through the barrier and into the soil under the periphery of the slab, aggregate materials in said trench of a sufficient quantity and size to permit the flow of water by percolation across said trench and to inhibit the flow of moisture by capillary migration across said trench, said aggregate material having a minimum particle dimension in access of ¼ of an inch whereby said barrier maintains the moisture content of the soil under the periphery of the slab at a desired level.

8. The structure of claim 7 wherein said trench comprising a first leg extending vertically downward a sufficient distance to inhibit capillary movement of water thereacross thereby limiting loss of moisture from beneath the slab and a second leg extending horizontally between the first leg and the slab for permitting percolation of water therethrough while inhibiting capillary movement of moisture across the second leg to maintain a moisture level in the soil under the slab.

9. The structure of claim 7 wherein said trench comprises a leg extending horizontally out away from the slab.

10. The structure of claim 7 wherein said barrier extends completely around the periphery of the slab.

11. In a method for stabilizing the moisture content of the soil at the periphery of a structure comprising the steps of:

constructing a moisture controlling barrier at the exterior of existing structure supported from the soil, the step of constructing the moisture controlling barrier comprising excavating a trench of a predetermined width and depth in the soil and abutting the periphery of the structure; and placing in said trench a sufficient quantity of aggregate material having a minimum particle dimension in excess of ¼ of an inch whereby capillary movement of moisture from under the slab to the soil surrounding the slab is inhibited and whereby movement of water by percolation into the soil under the slab is permitted.

12. The method of claim 11 wherein the step of forming a trench comprises forming a first leg of said trench extending vertically downward a sufficient distance to inhibit capillary movement of water thereacross thereby limiting loss of moisture from beneath the foundation and forming a second leg extending horizontally between the first leg and the slab for permitting percolation of water therethrough while inhibiting capillary movement of moisture across the second leg to maintain the moisture level in soil under the slab.

13. The method of claim 11 wherein said step of forming the trench comprises forming a leg extending horizontally out away from the foundation.

14. The method of claim 11 wherein said step of constructing the moisture controlling barrier comprises excavating said trench completely around the structure.

15. A moisture controlling barrier for reducing the damage to a slab due to shrinking and swelling of soil because of moisture variations in the soil at the periphery of the slab by stablilizing the moisture content of the soil at the periphery of the slab, comprising:

a moisture controlling barrier of aggregate material in the soil and abutting the periphery of the slab, said aggregate material having a minimum particle dimension of ¼ of an inch, said barrier being of a sufficient size and width to prevent the capillary migration of moisture across the barrier whereby the loss of moisture from under the slab is reduced and to permit percolation of moisture across the barrier whereby moisture may be added to the soil under the foundation whereby the moisture content of the soil at the periphery of the slab is maintained.

16. A moisture controlling barrier as defined in claim 15 wherein said barrier extends completely around said slab.

17. In a slab foundation construction for use in high shrink-swell soils to reduce damage due to shrinking and swelling of the soil by stabilizing the moisture content of the soil at the periphery of the slab, comprising a slab supported by the soil, and a moisture controlling barrier in the soil at the periphery of the slab, the improvement which comprises said barrier comprising a moisture controlling barrier of aggregate material in the soil and abutting the periphery of the slab, said aggregate material having a minimum particle dimension of ¼ of an inch, said barrier being of a sufficient size and width to prevent the capillary migration of moisture across the barrier whereby the loss of moisture from under the slab is reduced and to permit percolation of moisture across the barrier whereby moisture may be added to the soil under the foundation whereby the moisture content at the periphery of the slab is maintained.

* * * * *

UNITED STATES PATENT OFFICE

CERTIFICATE OF CORRECTION

Patent No. 4,015,432 Dated April 5, 1977

Inventor(s) Henry F. Ball

It is certified that error appears in the above-identified patent and that said Letters Patent are hereby corrected as shown below:

Column 4, line 2, "walls 15." should be --walls 14.--;
line 66, "pressure" should be --moisture--.

Column 5, line 17, "dotted" should be --solid--.

Column 6, line 34, "T-shaped" should be --"T" shaped--;
line 37, "leg T with" should be --leg "T" with--.

Column 8, line 49, "slab soil" should be --slab to the soil--.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*